US011456559B2

(12) United States Patent
Tsukada et al.

(10) Patent No.: US 11,456,559 B2
(45) Date of Patent: Sep. 27, 2022

(54) RUBBER PLUG WIRE SEAL

(71) Applicant: SUMITOMO WIRING SYSTEMS, LTD., Mie (JP)

(72) Inventors: Namiki Tsukada, Mie (JP); Yukihiro Fukatsu, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/212,242

(22) Filed: Mar. 25, 2021

(65) Prior Publication Data

US 2021/0313735 A1 Oct. 7, 2021

(30) Foreign Application Priority Data

Apr. 6, 2020 (JP) ..... JP2020-068155

(51) Int. Cl.
*H01R 13/52* (2006.01)

(52) U.S. Cl.
CPC ..... *H01R 13/5205* (2013.01); *H01R 13/5216* (2013.01)

(58) Field of Classification Search
CPC ..... H01R 13/5205; H01R 13/5216; H02G 15/013; B60R 16/0222
See application file for complete search history.

(56) References Cited

U.S. PATENT DOCUMENTS 5,562,494 A * 10/1996 Fujiwara ..... H01R 13/5205 439/275
5,660,566 A * 8/1997 Ohsumi ..... H01R 13/5205 439/275

FOREIGN PATENT DOCUMENTS

JP 2003-272758 A 9/2003

* cited by examiner

*Primary Examiner* — Vanessa Girardi
(74) *Attorney, Agent, or Firm* — Venjuris, P.C.

(57) ABSTRACT

A rubber plug A includes a tubular seal functioning portion 10 through which a wire 20 is passed, and a tubular portion 15 through which the wire 20 is passed. The seal functioning portion 10 exhibits a sealing function by being held resiliently in close contact with an inner peripheral surface of a terminal accommodation chamber 29 and an outer peripheral surface of the wire 20. The tubular portion 15 is disposed behind the seal functioning portion 10. Weight portions 16 relatively displaceable with respect to the tubular portion 15 are formed on the outer periphery of the tubular portion 15.

5 Claims, 7 Drawing Sheets

RUBBER PLUG WIRE SEAL

CROSS-REFERENCE TO RELATED APPLICATIONS

This application is based on and claims priority from Japanese Patent Application No. 2020-068155, filed on Apr. 6, 2020, with the Japan Patent Office, the disclosure of which is incorporated herein in its entirety by reference.

TECHNICAL FIELD

The present disclosure relates to a rubber plug.

BACKGROUND

Japanese Patent Laid-open Publication No. 2003-272758 discloses a rubber plug to be inserted into a housing with a wire penetrating therethrough. A terminal fitting is crimped to a front end part of the rubber plug together with the wire. A part of the wire drawn out rearward of the rubber plug is routed outside the housing.

SUMMARY

If the rubber plug is mounted on a connector for vehicle, the wire swings with the rear end of the rubber plug as a fulcrum due to vibration during travel. At this time, since the wire is bent with a small radius of curvature at the rear end of the rubber plug, if the wire repeatedly swings, there is a concern that the wire is broken at the rear end of the rubber plug.

A rubber plug of the present disclosure was completed on the basis of the above situation and aims to prevent the breakage of a wire.

The present disclosure is directed to a rubber plug with a tubular seal functioning portion, a wire being passed through the seal functioning portion, and a tubular portion, the wire being passed through the extended portion, wherein the seal functioning portion exhibits a sealing function by being held resiliently in close contact with an inner peripheral surface of a terminal accommodation chamber and an outer peripheral surface of the wire, the tubular portion is disposed behind the seal functioning portion, and a weight portion relatively displaceable with respect to the tubular portion is formed on an outer periphery of the tubular portion.

According to the present disclosure, it is possible to prevent the breakage of a wire.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
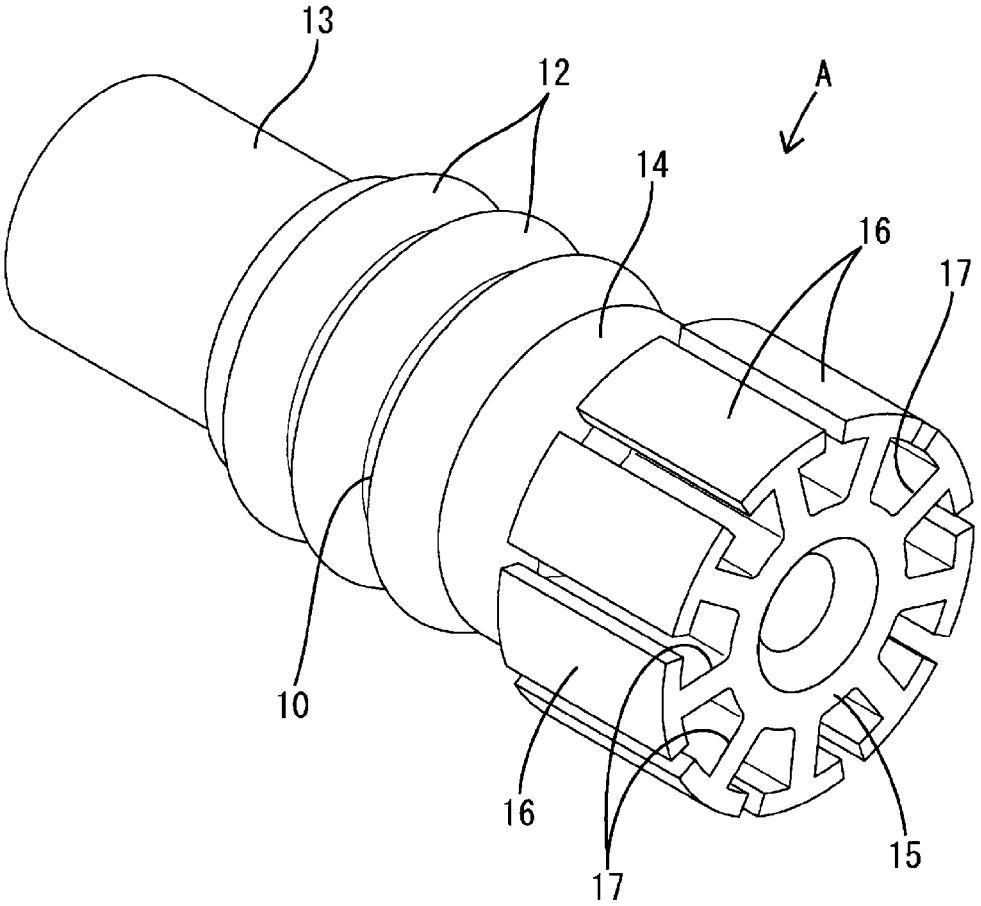
FIG. 1 is a perspective view of a rubber plug of a first embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The rubber plug of the present disclosure includes a tubular seal functioning portion, a wire being passed through the seal functioning portion, and a tubular portion, the wire being passed through the extended portion, wherein the seal functioning portion exhibits a sealing function by being held resiliently in close contact with an inner peripheral surface of a terminal accommodation chamber and an outer peripheral surface of the wire, the tubular portion is disposed behind the seal functioning portion, and a weight portion relatively displaceable with respect to the tubular portion is formed on an outer periphery of the tubular portion. According to this configuration, when the tubular portion swings, following the wire, the vibrational energy of the wire is attenuated by a relative displacement of the weight portion with respect to the tubular portion. Therefore, there is no possibility that the wire is broken.

(2) Preferably, the weight portion radially projects from the outer periphery of the tubular portion and is shaped such that a projecting end part is branched in a back view of the tubular portion viewed in an axial direction. According to this configuration, since a center of gravity of the weight portion is disposed at a position separated from the outer peripheral surface of the tubular portion in the back view, there is a high effect in attenuating the vibrational energy of the wire.

(3) Preferably, the projecting end part of the weight portion is branched into a T shape. According to this configuration, since the center of gravity of the weight portion is disposed at a position separated from the outer peripheral surface of the tubular portion in the back view, there is a high effect in attenuating the vibrational energy of the wire.

(4) Preferably, the projecting end part of the weight portion is branched into a Y shape. According to this configuration, since the center of gravity of the weight portion is disposed at a position separated from the outer peripheral surface of the tubular portion in the back view, there is a high effect in attenuating the vibrational energy of the wire.

(5) Preferably, the projecting end part of the weight portion is branched into an m shape. According to this configuration, since the center of gravity of the weight portion is disposed at a position separated from the outer peripheral surface of the tubular portion in the back view, there is a high effect in attenuating the vibrational energy of the wire.

(6) Preferably, an inner diameter of the tubular portion is not larger than an outer diameter of the wire. According to this configuration, since the inner peripheral surface of the tubular portion can be held in close contact with the outer peripheral surface of the wire, the vibrational energy of the wire can be effectively attenuated.

(7) Preferably, the rubber plug includes a tubular extended portion, the wire being passed through the extended portion, the extended portion extends rearward from a rear end of the seal functioning portion and is connected to a front end of the tubular portion, and a radial thickness of the extended portion is smaller than a largest radial thickness of the seal functioning portion in a free state where neither the seal functioning portion nor the extended portion is resiliently deformed. According to this configuration, since the extended portion is less radially squeezed than the seal functioning portion in a state where the rubber plug having the wire passed therethrough is accommodated in the terminal accommodation chamber, the extended portion is more easily resiliently deformed than the seal functioning portion. Since an inner peripheral rear end part of the extended portion is resiliently deformed, following the wire, when the wire swings behind the rubber plug, there is no possibility that the wire is bent with a small radius of curvature. Therefore, there is no possibility that the wire is broken even if the wire repeatedly swings.

(8) Preferably, the rubber plug includes a tubular terminal fixing portion extending forward from a front end of the seal functioning portion and enabling fixing of a terminal fitting, and an outer peripheral shape of the tubular portion including the weight portion is different from that of the terminal fixing portion. According to this configuration, since the front-rear orientation of the rubber plug can be distinguished, it can be prevented that the terminal fitting is erroneously fixed to the tubular portion.

DETAILS OF EMBODIMENTS OF PRESENT DISCLOSURE

First Embodiment

Figure 2:
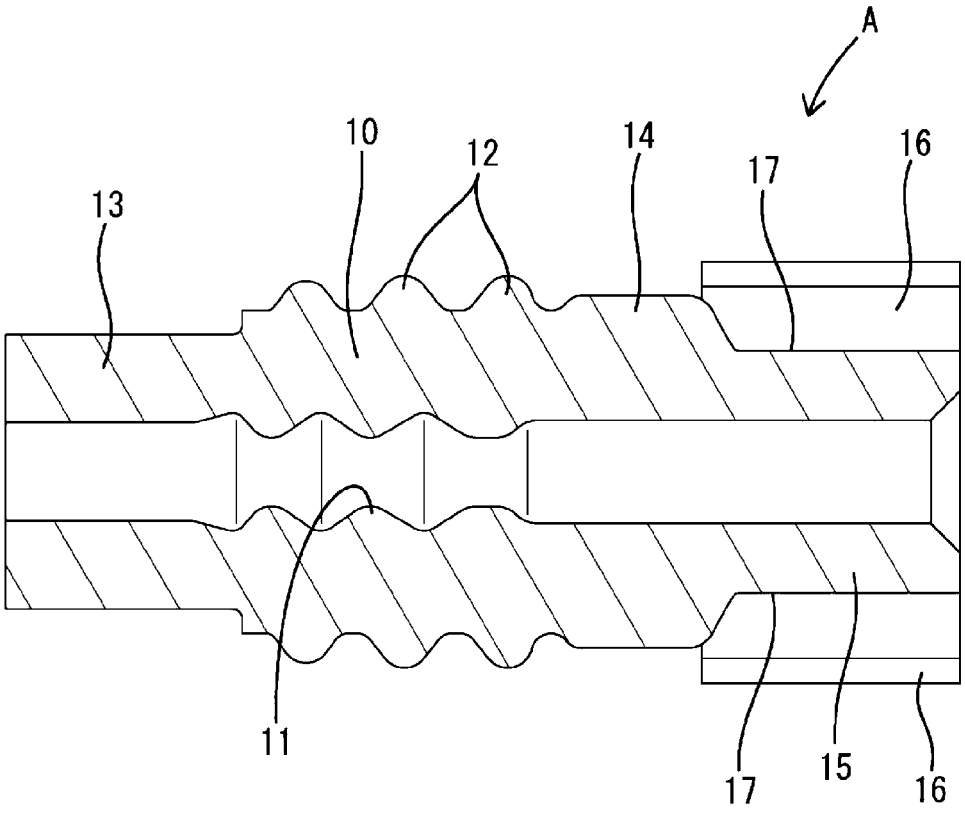
FIG. 2 is a side view in section of the rubber plug.
Figure 3:
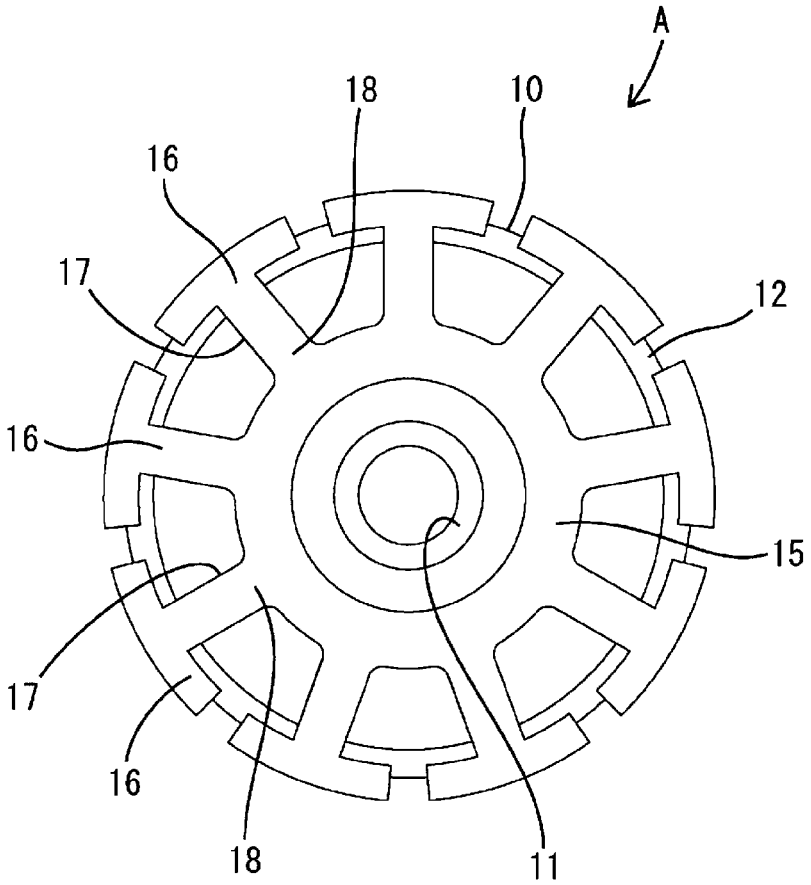
FIG. 3 is a back view of the rubber plug.
Figure 4:
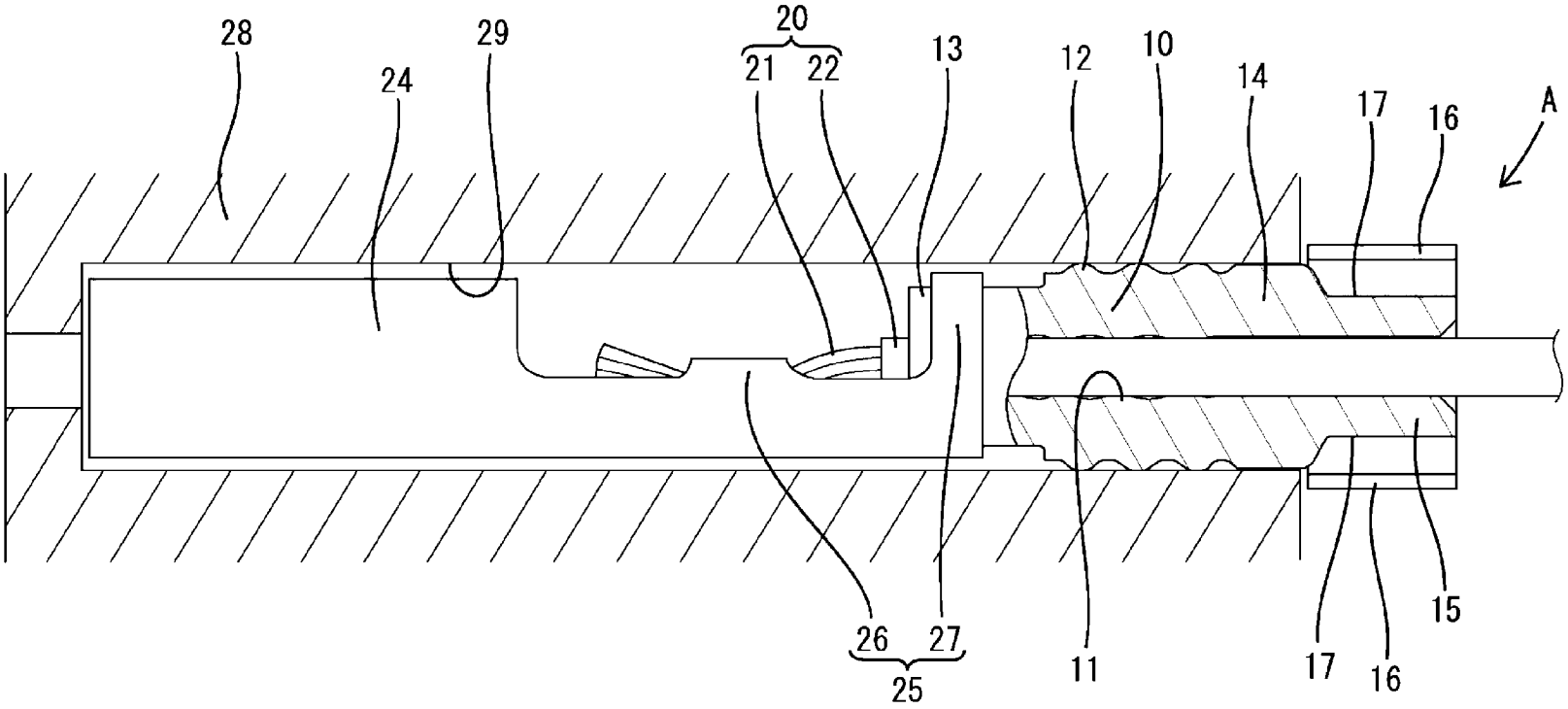
FIG. 4 is a side view in section showing a state where the rubber plug fixed to a terminal fitting is accommodated in a terminal accommodation chamber.

A first specific embodiment of a rubber plug A of the present disclosure is described with reference to FIGS. 1 to 4. Note that the present invention is not limited to these illustrations and is intended to be represented by claims and include all changes in the scope of claims and in the meaning and scope of equivalents. In this first embodiment, a left side in FIGS. 2 and 4 is defined as a front side concerning a front-rear direction. The front-rear direction and an axial direction are used as synonyms.

As shown in FIG. 4, the rubber plug A of this embodiment surrounds a front end part of a wire 20 in which a conductor 21 is surrounded by an insulation coating 22. The rubber plug A is fixed to a terminal fitting 24 together with the wire 20 and accommodated into a terminal accommodation chamber 29 of a housing 28. The rubber plug A exhibits a waterproof function of sealing between the outer peripheral surface of the wire 20 and the inner peripheral surface of the terminal accommodation chamber 29 in a liquid-tight manner. The housing 28 constitutes a connector (not shown) of a wiring harness to be installed in a vehicle.

The terminal fitting 24 has an elongated shape in the front-rear direction as a whole. A rear end part of the terminal fitting 24 is formed with a crimping portion 25 in the form of an open barrel to be crimped to the front end part of the wire 20. The crimping portion 25 is composed of a wire barrel portion 26 and an insulation barrel portion 27 connected to the rear end of the wire barrel portion 26. The wire barrel portion 26 is fixed to the conductor 21 exposed by removing the insulation coating 22 in the front end part of the wire 20. The insulation barrel portion 27 is fixed to a terminal fixing portion 13 of a front end part of the rubber plug A externally fit to the wire 20.

The rubber plug A is a single component having a hollow cylindrical shape as a whole. As shown in FIGS. 1 and 2, the rubber plug A includes a seal functioning portion 10, the terminal fixing portion 13, an extended portion 14 and a tubular portion 15. A plurality of inner peripheral side lip portions 11 extending in a circumferential direction are formed at constant intervals in the front-rear direction on the inner peripheral surface of the seal functioning portion 10. A plurality of outer peripheral side lip portions 12 extending in the circumferential direction are formed at constant intervals in the front-rear direction on the outer peripheral surface of the seal functioning portion 10. The inner peripheral side lip portions 11 are held in close contact with the outer peripheral surface of the insulation coating 22 of the wire 20 in a liquid-tight manner. The outer peripheral side lip portions 12 are held in close contact with the inner peripheral surface of the terminal accommodation chamber 29 in a liquid-tight manner.

The terminal fixing portion 13 extends forward coaxially from the tip of the seal functioning portion 10. Dimensions of the terminal fixing portion 13 in a state where the wire 20 is not passed through the rubber plug A are as follows. An inner diameter and an outer diameter of the terminal fixing portion 13 are both constant over the entire length from the front end to the rear end of the terminal fixing portion 13. The inner diameter of the terminal fixing portion 13 is larger than a smallest inner diameter of the seal functioning portion 10. The outer diameter of the terminal fixing portion 13 is smaller than a largest outer diameter of the seal functioning portion 10.

The extended portion 14 is extended rearward coaxially from the rear end of the seal functioning portion 10. Dimensions of the extended portion 14 in the state where the wire 20 is not passed through the rubber plug A are as follows. A dimension in the front-rear direction of the extended portion 14 is smaller than those of the seal functioning portion 10 and the terminal fixing portion 13. An inner diameter and an outer diameter of the extended portion 14 are both constant over the entire length from the front end to the rear end of the extended portion 14. The inner diameter of the extended portion 14 is larger than the smallest inner diameter of the seal functioning portion 10. The inner diameter of the extended portion 14 is not larger than an outer diameter of the wire 20, i.e. equal to or smaller than the outer diameter of the wire 20. The outer diameter of the extended portion 14 is smaller than the largest outer diameter of the seal functioning portion 10. The outer diameter of the extended portion 14 is not smaller than an inner diameter of the terminal accommodation chamber 29, i.e. equal to or slightly larger than the inner diameter of the terminal accommodation chamber 14. A radial thickness of the extended portion 14 is smaller than a largest radial thickness of the seal functioning portion 10.

The tubular portion 15 includes a plurality of weight portions 16 and a plurality of recesses 17 as a distinguishing portion. As shown in FIGS. 1 and 3, the plurality of weight portions 16 and the plurality of recesses 17 are alternately arranged at constant intervals in the circumferential direction. The weight portion 16 is formed over the entire length from the front end to the rear end of the tubular portion 15. The weight portion 16 radially projects from the outer periphery of the tubular portion 15. A base end 18 of the weight portion 16 is connected to the outer peripheral surface of the tubular portion 15. The weight portion 16 is shaped such a projecting end part is branched into a T shape in a back view (see FIG. 3) of the tubular portion 15 viewed in the axial direction. In the back view, a center of gravity of the weight portion 16 is arranged at a position closer to the projecting end than to the base end 18 of the weight portion 16, i.e. at a position separated from the outer periphery of the tubular portion 15. The plurality of weight portions 16 and the plurality of recesses 17 also function as the distinguishing portion. The distinguishing portion is a part for distinguishing a shape difference between the terminal fixing portion 13 and the tubular portion 15 by visual observation.

A part of the wire 20 drawn out rearward from the rear end of the rubber plug A and routed outside the housing 28 is defined as a draw-out region. If the draw-out region of the wire 20 swings vertically and/or laterally, the tubular portion 15 resiliently swings, following the wire 20, and each weight portion 16 is resiliently relatively displaced with respect to the tubular portion 15. Since the vibrational energy of the wire 20 is attenuated by the resilient swing of the tubular portion 15 and resilient relative displacements of the weight portions 16, a swing width of the wire 20 in a rear end part of the rubber plug A is reduced. Therefore, there is no possibility that the wire 20 is broken.

Dimensions of the tubular portion 15 in the state where the wire 20 is not passed through the rubber plug A are as follows. An inner diameter of the tubular portion 15 is constant over the entire length from the front end to the rear end of the tubular portion 15 and equal to the inner diameter of the extended portion 14. Thus, no step is present between the inner peripheral surface of the extended portion 14 and the inner peripheral surface of the tubular portion 15. An outer diameter of parts of the tubular portion 15 where the recesses 17 are formed is smaller than the outer diameter of the extended portion 14. An outer diameter of parts of the tubular portion 15 where the recesses 17 are not formed, i.e. where the weight portions 16 are formed, is larger than the outer diameter of the extended portion 14. The rigidity of the tubular portion 15 in a state where an external force acts to curve an axis of the rubber plug A is lower than that of the extended portion 14.

In a state where the rubber plug A fixed to the terminal fitting 24 and the wire 20 is inserted in the terminal accommodation chamber 29, the entire terminal fixing portion 13, the entire seal functioning portion 10 and the entire extended portion 14 are accommodated in the terminal accommodation chamber 29. The seal functioning portion 10 is resiliently deformed to be radially squeezed, the inner peripheral side lip portions 11 are resiliently held in close contact with the outer peripheral surface of the wire 20 and the outer peripheral side lip portions 12 are resiliently held in close contact with the inner peripheral surface of the terminal accommodation chamber 29. A clearance between the outer periphery of the wire 20 and the inner periphery of the terminal accommodation chamber 29 is sealed in a liquid-tight manner by these close contacts. The inner peripheral surface of the extended portion 14 is in contact with the outer peripheral surface of the wire 20, and the outer peripheral surface of the extended portion 14 is in contact with the inner peripheral surface of the terminal accommodation chamber 29.

The entire tubular portion 15 projects outward of the terminal accommodation chamber 29, i.e. rearward to the outside of the housing 28. A region of the wire 20 behind the rubber plug A is also drawn out rearward to the outside of the housing 28. The draw-out region of the wire 20 routed outside the housing 28 swings due to vibration during vehicle travel or engine vibration. At this time, the draw-out region of the wire 20 swings with the rear end part of the rubber plug A as a fulcrum. If the wire 20 is bent with a small radius of curvature at the swing fulcrum, there is a concern that the conductor 21 of the wire 20 is broken due to repeated swings.

As a countermeasure against this, the tubular portion 15 is formed in the rear end part of the rubber plug A. Since the tubular portion 15 is lower in rigidity than the extended portion 14, if the wire 20 swings, the tubular portion 15 resiliently swings, following the wire 20. Since the vibrational energy of the wire 20 is attenuated by the resilient deformation of the tubular portion 15, a swing width of the wire 20 in the tubular portion 15 and the extended portion 14 is reduced.

Further, if the tubular portion 15 is flexibly resiliently deformed, there is a concern that the wire 20 is bent with a small radius of curvature at the rear end of the extended portion 14 connected to the front end of the tubular portion 15 and the wire 20 is broken in this bent part. As a countermeasure against this, the radial thickness of the extended portion 14 is set smaller than the largest thickness of the seal functioning portion 10. In this way, an amount of the extended portion 14 to be radially squeezed between the wire 20 and the terminal accommodation chamber 29, i.e. a radial resilient deformation amount, becomes smaller than that of the seal functioning portion 10. Thus, a stress generated in an inner peripheral part of the extended portion 14 is smaller than that generated in the seal functioning portion 10. That is, when the wire 20 swings, an inner peripheral rear end part of the extended portion 14 is relatively easily resiliently deformed. Therefore, there is no possibility that the wire 20 is bent with a small radius of curvature at the rear end of the extended portion 14, and the breakage of the wire 20 is prevented.

The rubber plug A of the first embodiment includes the tubular seal functioning portion 10 through which the wire 20 is passed, and the tubular portion 15 through which the wire 20 is passed. The seal functioning portion 10 exhibits a sealing function by being resiliently held in close contact with the inner peripheral surface of the terminal accommodation chamber 29 and the outer peripheral surface of the wire 20. The tubular portion 15 is lower in rigidity than the seal functioning portion 10 and disposed behind the seal functioning portion 10. When the wire 20 swings behind the rubber plug A, the tubular portion 15 resiliently swings, following the wire 20, whereby the vibration energy of the wire 20 is attenuated. Since the swing width of the wire 20 in the rubber plug A is reduced in this way, the breakage of the wire 20 can be prevented.

The weight portion 16 radially projects from the outer periphery of the tubular portion 15. The weight portion 16 is shaped such that the projecting end part is branched into a T shape in the back view of the tubular portion 15 viewed in the axial direction. According to this configuration, since the center of gravity of the weight portion 16 is disposed at the position separated from the outer peripheral surface of the tubular portion 15 in the back view, there is a high effect in attenuating the vibrational energy of the wire 20.

The rubber plug A includes the tubular extended portion 14 through which the wire 20 is passed. The extended portion 14 extends rearward from the rear end of the seal functioning portion 10 and is connected to the front end of the tubular portion 15. In a free state where neither the seal functioning portion 10 nor the extended portion 14 is resiliently deformed, the extended portion 14 is less radially squeezed than the seal functioning portion 10. Since the amount of the extended portion 14 to be radially squeezed is less than that of the seal functioning portion 10 to be radially squeezed in the state where the rubber plug A having the wire 20 passed therethrough is accommodated in the terminal accommodation chamber 29, the extended portion 14 is more easily resiliently deformed than the seal functioning portion 10. Since the inner peripheral rear end part of the extended portion 14 is resiliently deformed, following a movement of the wire 20, when the wire 20 swings behind the rubber plug A, there is no possibility that the wire 20 is bent with a small radius of curvature. Therefore, even if the wire 20 repeatedly swings, there is no possibility that the wire 20 is broken.

Since the inner diameter of the tubular portion 15 is not larger than the outer diameter of the wire 20, i.e. equal to or smaller than the outer diameter of the wire 20, the inner peripheral surface of the tubular portion 15 can be held in close contact with the outer peripheral surface of the wire 20. In this way, the vibrational energy of the wire 20 can be effectively attenuated. Since the inner diameter of the tubular portion 15 is equal to that of the extended portion 14, there is no step in a part where the inner peripheral rear end of the extended portion 14 and the inner peripheral front end of the tubular portion 15 are connected. In this way, a stress concentration in the wire 20 can be alleviated.

Since the tubular portion 15 is formed with the recesses 15 in the outer peripheral surface, the rigidity of the tubular portion 15 can be reduced even if the inner peripheral surface of the tubular portion 15 is formed into a circular cross-section. In this way, the inner peripheral surface of the tubular portion 15 can be held in close contact with the outer peripheral surface of the wire 20, wherefore the vibrational energy of the wire 20 can be effectively attenuated.

The rubber plug A includes the tubular terminal fixing portion 13 extending forward from the front end of the seal functioning portion 10 and enabling the fixing of the terminal fitting 24. On the outer periphery of the tubular portion 15, the recesses 17 and the weight portions 16 are formed as the distinguishing portion different in shape from the outer peripheral surface of the terminal fixing portion 13. Since the front-rear orientation of the rubber plug A can be distinguished by these recesses 17 and weight portions 16, it can be prevented that the crimping portion 25 of the terminal fitting 24 is erroneously fixed to the tubular portion 15.

Second Embodiment

Figure 5:
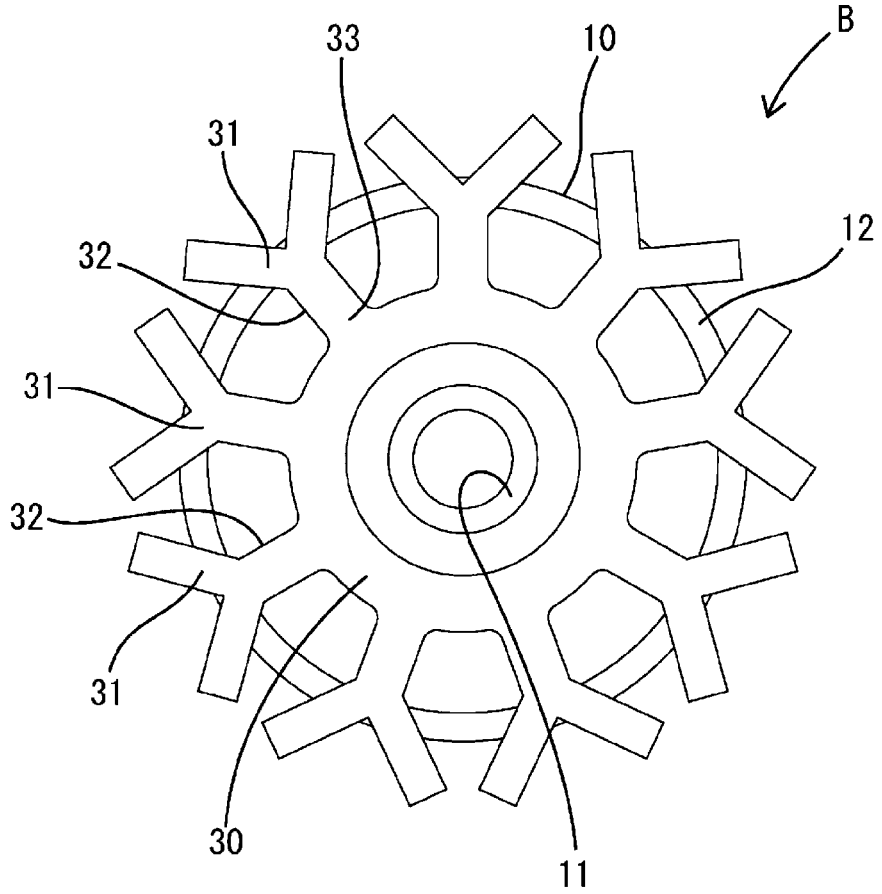
FIG. 5 is a back view of a rubber plug of a second embodiment.

A rubber plug B as a specific second embodiment of the present disclosure is described with reference to FIG. 5. The rubber plug B of this second embodiment is different from the first embodiment in the configuration of a tubular portion 30. Since the other components are the same as in the first embodiment, the same components are denoted by the same reference signs and the structures, functions and effects thereof are not described.

A plurality of weight portions 31 and a plurality of recesses 32 are formed on the outer periphery of the tubular portion 30 of the second embodiment. The plurality of weight portions 31 and the plurality of recesses 32 are alternately arranged at constant intervals in a circumferential direction. The weight portion 31 radially projects from the outer periphery of the tubular portion 30. A base end 33 of the weight portion 31 is connected to the outer peripheral surface of the tubular portion 30. In a back view (see FIG. 5) of the tubular portion 30 viewed in an axial direction, the weight portion 31 is shaped such that a projecting end part is branched into a Y shape. In the back view, a center of gravity of the weight portion 31 is arranged at a position closer to a projecting end than to the base end 33 of the weight portion 31, i.e. at a position separated from the outer periphery of the tubular portion 30.

If a draw-out region of a wire 20 (not shown in FIG. 5) swings, the tubular portion 30 resiliently swings, following the wire 20, and each weight portion 31 is resiliently relatively displaced with respect to the tubular portion 30. Since the vibrational energy of the wire 20 is attenuated by the resilient swing of the tubular portion 30 and resilient relative displacements of the weight portions 31, a swing width of the wire 20 in a rear end part of the rubber plug B is reduced. Therefore, there is no possibility that the wire 20 is broken. The plurality of weight portions 31 and the plurality of recesses 32 also function as a distinguishing portion. The distinguishing portion is a part for distinguishing a shape difference between a terminal fixing portion 13 (not shown in FIG. 5) and the tubular portion 30 by visual observation.

Third Embodiment

Figure 6:
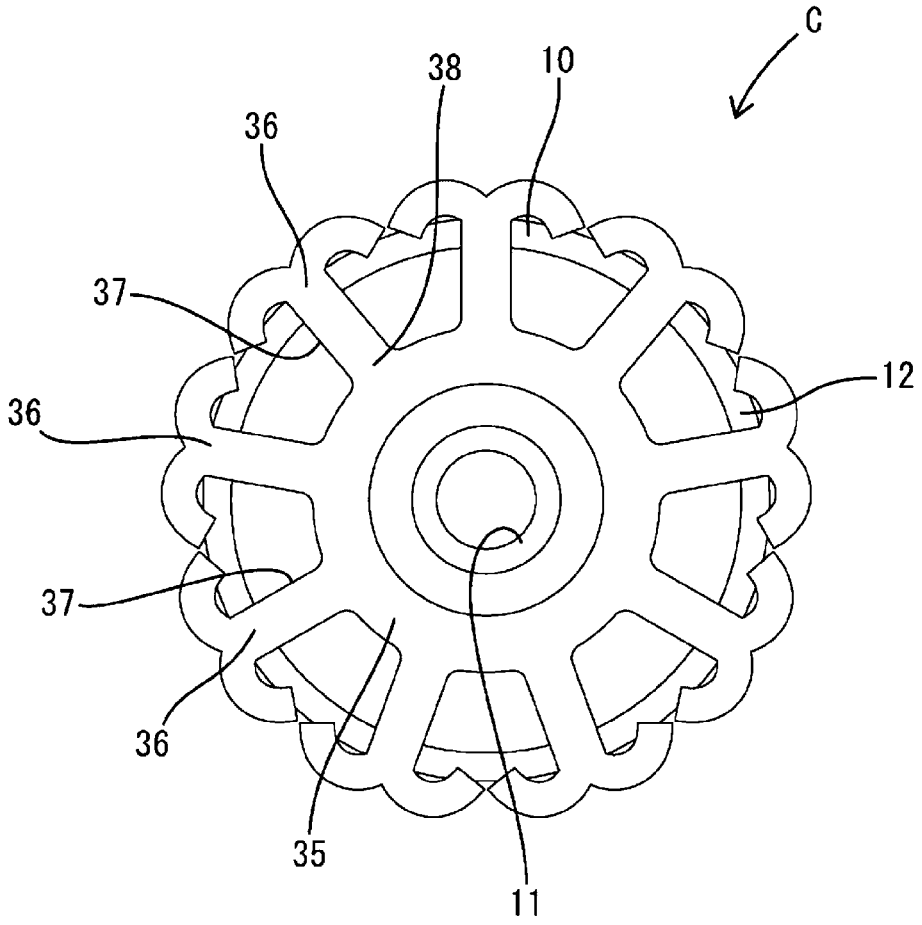
FIG. 6 is a back view of a rubber plug of a third embodiment.

A rubber plug C as a specific third embodiment of the present disclosure is described with reference to FIG. 6. The rubber plug C of this third embodiment is different from the first embodiment in the configuration of a tubular portion 35. Since the other components are the same as in the first embodiment, the same components are denoted by the same reference signs and the structures, functions and effects thereof are not described.

A plurality of weight portions 36 and a plurality of recesses 37 are formed on the outer periphery of the tubular portion 35 of this third embodiment. As shown, the plurality of weight portions 36 and the plurality of recesses 37 are alternately arranged at constant intervals in a circumferential direction. The weight portion 36 radially projects from the outer periphery of the tubular portion 35. A base end 38 of the weight portion 36 is connected to the outer peripheral surface of the tubular portion 35. In a back view (see FIG. 6) of the tubular portion 35 viewed in an axial direction, the weight portion 36 is shaped such that a projecting end part is branched into an m shape. In the back view, a center of gravity of the weight portion 36 is arranged at a position closer to a projecting end than to the base end 38 of the weight portion 36, i.e. at a position separated from the outer periphery of the tubular portion 35.

If a draw-out region of a wire 20 (not shown in FIG. 6) swings, the tubular portion 35 resiliently swings, following the wire 20, and each weight portion 36 is resiliently relatively displaced with respect to the tubular portion 35. Since the vibrational energy of the wire 20 is attenuated by the resilient swing of the tubular portion 35 and resilient relative displacements of the weight portions 36, a swing width of the wire 20 in a rear end part of the rubber plug C is reduced. Therefore, there is no possibility that the wire 20 is broken. The plurality of weight portions 36 and the plurality of recesses 37 also function as a distinguishing portion. The distinguishing portion is a part for distinguishing a shape difference between a terminal fixing portion 13 (not shown in FIG. 6) and the tubular portion 35 by visual observation.

Fourth Embodiment

Figure 7:
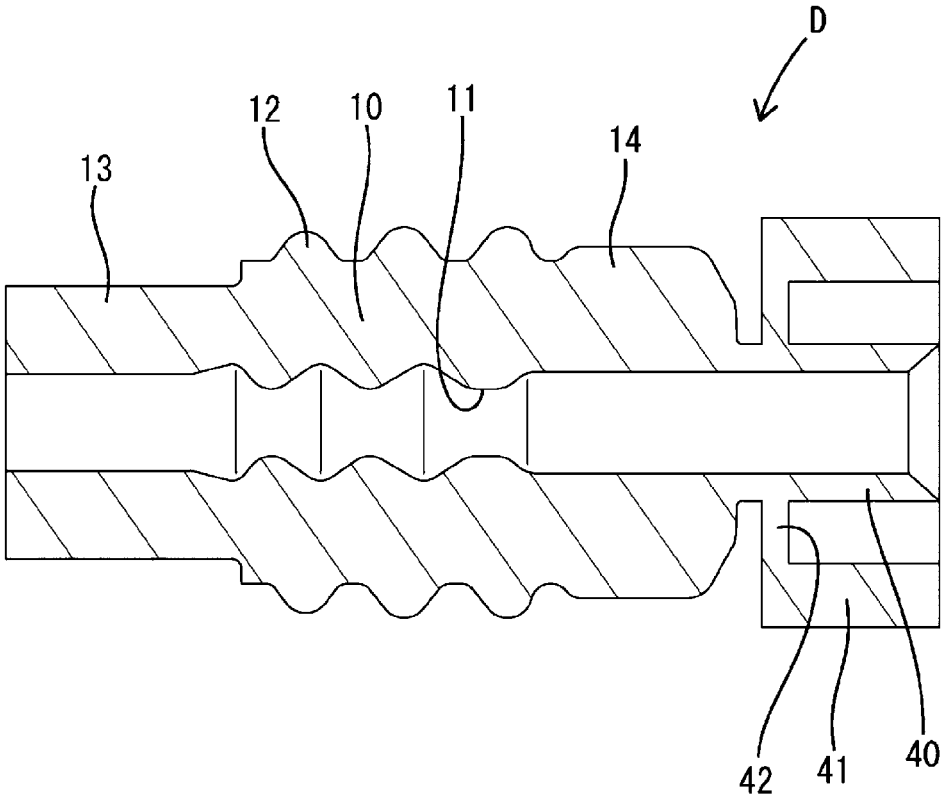
FIG. 7 is a side view in section of a rubber plug of a fourth embodiment.

A rubber plug D as a specific fourth embodiment of the present disclosure is described with reference to FIG. 7. The rubber plug D of this fourth embodiment is different from the first embodiment in the configuration of a tubular portion 40. Since the other components are the same as in the first embodiment, the same components are denoted by the same reference signs and the structures, functions and effects thereof are not described.

A hollow cylindrical weight portion 41 and a supporting portion 42 linking the weight portion 41 to the tubular portion 40 are formed on the outer periphery of the tubular portion 40 of this fifth embodiment. An inner diameter of the weight portion 41 is larger than an outer diameter of the tubular portion 40. The weight portion 41 is arranged coaxially with the tubular portion 40. The supporting portion 42 is in the form of an annular plate perpendicular to an axis of the rubber plug D. The inner periphery of the supporting portion 42 is connected to the outer periphery of the tubular portion 40. The outer peripheral edge of the supporting portion 42 is connected to an inner peripheral front end part of the weight portion 41.

A radial thickness of the tubular portion 40 is sufficiently smaller than that of an extended portion. A plate thickness in a front-rear direction of the supporting portion 42 is smaller than a radial thickness of the weight portion 41. A plate thickness of the supporting portion 42 is not larger than the radial thickness of the tubular portion 40, i.e. equal to or slightly smaller than the radial thickness of the tubular portion 40. The radial thickness of the weight portion 41 is sufficiently larger than the thickness of the tubular portion 40 and the plate thickness of the supporting portion 42. Since the inner diameter of the weight portion 41 is larger than the outer diameter of the tubular portion 40, the weight of the weight portion 41 is sufficiently larger than that of the tubular portion 40.

If a draw-out region of a wire 20 (not shown in FIG. 7) swings, the tubular portion 40 resiliently swings, following the wire 20, and the weight portion 41 is resiliently relatively displaced with respect to the tubular portion 40. At this time, the weight portion 41 itself is not resiliently deformed, but the supporting portion 42 linking the tubular portion 40 and the weight portion 41 is resiliently deformed. Since the vibrational energy of the wire 20 is attenuated by the resilient swing of the tubular portion 40 and a resilient relative displacement of the weight portion 41, a swing width of the wire 20 in a rear end part of the rubber plug D is reduced. Therefore, there is no possibility that the wire 20 is broken. The weight portion 41 also functions as a distinguishing portion. The distinguishing portion is a part for distinguishing a shape difference between a terminal fixing portion 13 and the tubular portion 40 by visual observation.

Other Embodiments

The present invention is not limited to the above described and illustrated first to fourth embodiments and is represented by claims. The present invention includes all changes in the meaning of equivalents to the scope of claims and in the scope of claims and is intended to also include the following embodiments.

Although the inner diameter of the tubular portion is not larger than the outer diameter of the wire in the above first to fourth embodiments, the inner diameter of the tubular portion may be larger than the outer diameter of the wire.

Although the extended portion is formed between the rear end of the seal functioning portion and the tubular portion in the above first to fourth embodiments, the front end of the tubular portion may be directly connected to the rear end of the seal functioning portion without providing the extended portion.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A rubber plug, comprising:

a tubular seal functioning portion, a wire being passed through the seal functioning portion; and a tubular portion, the wire being passed through the tubular portion, wherein:

the seal functioning portion exhibits a sealing function by being held resiliently in close contact with an inner peripheral surface of a terminal accommodation chamber and an outer peripheral surface of the wire, the tubular portion is disposed behind the seal functioning portion, a weight portion relatively displaceable with respect to the tubular portion is formed on an outer periphery of the tubular portion, the weight portion radially projects from the outer periphery of the tubular portion and is shaped such that a projecting end part is branched in a back view of the tubular portion viewed in an axial direction, and the projecting end part of the weight portion is branched into a T shape.

2. The rubber plug of claim 1, wherein an inner diameter of the tubular portion is not larger than an outer diameter of the wire.

3. The rubber plug of claim 1, comprising a tubular extended portion, the wire being passed through the extended portion, wherein:

the extended portion extends rearward from a rear end of the seal functioning portion and is connected to a front end of the tubular portion, and a radial thickness of the extended portion is smaller than a largest radial thickness of the seal functioning portion in a free state where neither the seal functioning portion nor the extended portion is resiliently deformed.

4. The rubber plug of claim 1, comprising a tubular terminal fixing portion extending forward from a front end of the seal functioning portion and enabling fixing of a terminal fitting, wherein:

an outer peripheral shape of the tubular portion including the weight portion is different from that of the terminal fixing portion.

5. A rubber plug, comprising:

a tubular seal functioning portion, a wire being passed through the seal functioning portion; and a tubular portion, the wire being passed through the tubular portion, wherein:

the seal functioning portion exhibits a sealing function by being held resiliently in close contact with an inner peripheral surface of a terminal accommodation chamber and an outer peripheral surface of the wire, the tubular portion is disposed behind the seal functioning portion, a weight portion relatively displaceable with respect to the tubular portion is formed on an outer periphery of the tubular portion, the weight portion radially projects from the outer periphery of the tubular portion and is shaped such that a projecting end part is branched in a back view of the tubular portion viewed in an axial direction, and the projecting end part of the weight portion is branched into an m shape.

* * * * *